US010101027B2

(12) United States Patent
Kohn

(10) Patent No.: US 10,101,027 B2
(45) Date of Patent: Oct. 16, 2018

(54) SYSTEMS AND METHODS FOR CESSATION OF CARBON MONOXIDE PRODUCTION

(71) Applicant: Mark Kohn, Glenview, IL (US)

(72) Inventor: Mark Kohn, Glenview, IL (US)

( * ) Notice: Subject to any disclaimer, the term of this patent is extended or adjusted under 35 U.S.C. 154(b) by 120 days.

(21) Appl. No.: 15/060,182

(22) Filed: Mar. 3, 2016

(65) Prior Publication Data

US 2016/0258622 A1 Sep. 8, 2016

Related U.S. Application Data

(60) Provisional application No. 62/128,679, filed on Mar. 5, 2015.

(51) Int. Cl.
*F23L 7/00* (2006.01)
*F23N 5/24* (2006.01)

(52) U.S. Cl.
CPC .... *F23N 5/242* (2013.01); *F23N 2900/05001* (2013.01)

(58) Field of Classification Search
CPC ..... G08B 17/117; G08B 21/14; F23N 2900/05001; F23N 5/242
See application file for complete search history.

(56) References Cited

U.S. PATENT DOCUMENTS 5,065,813 A * 11/1991 Berkeley ..... G05D 23/1917 165/11.1
5,576,739 A * 11/1996 Murphy ..... F27D 19/00 340/3.4
5,838,243 A 11/1998 Gallo
6,045,352 A 4/2000 Nicholson
6,339,379 B1 1/2002 Argus
6,484,951 B1 * 11/2002 Mueller ..... G05D 23/1902 126/116 A
2008/0182215 A1 * 7/2008 Sid ..... B60K 28/10 431/18

(Continued)

OTHER PUBLICATIONS

Nest Labs, "What is Emergency Shutoff?", www.nest.com/support/article/How-the-Nest-Thermostat-and-Nest-Protect-work-together-in-a-carbon-monoxide-emergency, Jun. 17, 2015.

(Continued)

*Primary Examiner* — Jason Lau
(74) *Attorney, Agent, or Firm* — Faegre Baker Daniels LLP

(57) ABSTRACT

Briefly, apparatus and methods for detecting and terminating production of undesirable gases, such as carbon monoxide ("CO"), at a potential source, such as a household appliance. The apparatus and methods may determine a threshold level of the gas. In one embodiment, the method and apparatus may determine whether to provide power to a power supply input of a controller of a potential gas producing device based on the detected level of gas, where providing power to the power supply input of the controller of the potential gas producing device enables the controller of the potential gas producing device to provide power to the potential gas producing device. In another embodiment, when gas concentrations about a potential source are above a maximum threshold, the system communicates with a fuel supply valve of the potential source to cause the valve thereof to interrupt the supply of fuel to the potential source.

14 Claims, 6 Drawing Sheets

(56) References Cited

U.S. PATENT DOCUMENTS

2010/0201531 A1* 8/2010 Pakravan ..... G08B 21/14
340/632

OTHER PUBLICATIONS

Flowtech Safety Systems, "Product Info," www.flowtechsafetysystems.com/product-info.html (accessed Mar. 3, 2016), 2014.
CoStar 9SS CO Safety Shutoff—US, www.amazon.com/CoStar-955-CO-Safety-Shutoff/dp/B000AQHHBE, Mar. 3, 2016.

* cited by examiner

SYSTEMS AND METHODS FOR CESSATION OF CARBON MONOXIDE PRODUCTION

RELATED APPLICATIONS

This application is a non-provisional of U.S. Provisional Application No. 62/128,679, filed on Mar. 5, 2015, and titled "Systems and Methods for Cessation of Carbon Monoxide Production," the entire contents of which are hereby incorporated by reference.

BACKGROUND OF THE DISCLOSURE

The present subject matter relates generally to terminating the production of an undesirable gas such as carbon monoxide ("CO"). More specifically, the present disclosures relate to systems and methods for stopping the production of a toxic gas, such as carbon monoxide, from a gas source, such as a furnace.

CO is a colorless, odorless, and tasteless gas that is toxic to humans at concentrations above approximately 35 parts per million. It is often produced by the incomplete combustion of fossil fuels, such as coal, petroleum, and natural gas. Common sources of CO found in homes and other inhabited structures are due to improperly vented, improperly operated, or malfunctioning engines or appliances that burn fossil fuels, including motor vehicles, stoves, clothes dryers, water heaters, generators, and furnaces.

Unfortunately, CO cannot be detected by human senses because it has no color, odor, or taste. Thus, it is possible for dangerous or deadly concentrations of CO to quickly accumulate undetected in an occupied and enclosed space within a residence or other building. This characteristic is why CO is sometimes referred to as the "silent killer." To combat this dire problem, CO detectors may be used to detect the presence of CO. The detectors, if they are used at all, are typically positioned where CO may accumulate, and concentrations of CO will trigger an audible alarm in the detector. The audible alarm, however, must be heard by individuals to alert them of potential danger. Once CO is detected, the source of the CO must then be investigated to terminate its production.

Such CO mitigation techniques, however, are insufficient to resolve the unfortunately dangerous and common problem of CO leakage. First of all, homeowners, for example, must takes steps to acquire a CO detector and properly position, operate, and maintain the detector to benefit from the technology. Second, the audible alarm of a CO detector may fail, thus allowing CO to continue to accumulate undetected. Even if the audible alarm of a CO detector does not fail, some person must be around to hear the alarm; otherwise CO will continue to accumulate undetected as well. Third, even if CO is detected, a long time span may occur between when the CO is first produced and when it is eventually stopped at its source, thus allowing deadly concentrations of the gas to collect during that time span. Finally, the process of accessing and investigating an appliance, for example, to shut off the fuel source contributing to CO production, unnecessarily exposes the investigator to the deadly toxin at the appliance.

In light of the foregoing, there remains a pervasive unmet need in the art for systems and methods for detecting and terminating the production of undesirable gases such as CO.

SUMMARY OF THE INVENTION

To meet one or more of the needs described above, the present disclosure provides novel and inventive apparatus and methods for detecting and terminating production of undesirable gases, such as CO, at a potential source, such as a household appliance. Although the below descriptions of the apparatus and methods may be described with reference to the detection and termination of CO, it is to be appreciated that the apparatus and methods may be applied as to the detection and termination of other gases as well.

One embodiment is directed to a system that includes a CO detector that is operatively associated with a potential source of CO, such as a household appliance having a fuel supply, wherein the operation of the source may be affected by the detector. The CO detector is preferably, but optionally, installed within the potential source of CO. The system may be in communication with a control board of the potential source of CO. For example, the control board of the potential source of the CO may be one that provides or regulates power to the potential source of CO. During normal operation of the system, when CO concentrations about the source are below a maximum threshold, the system communicates with the control board to allow the control board to supply power to the potential source of CO. However, when CO concentrations about the source are above a maximum threshold, the system communicates with the control board to cut off power to the potential source of CO. In this regard, the potential source of CO is rendered incapable of contributing to the unacceptable concentration of CO about the source because it's no longer powered and thus incapable of burning fuel.

In one embodiment, the system is in communication with a gas valve (e.g., and electronic gas valve) of a fuel supply of the potential source of CO, such as a natural gas supply line, via a wired or wireless connection. During normal operation of the system, when CO concentrations about the source are below a maximum threshold, the system communicates with the fuel supply to cause the gas valve thereof to remain open and provide the source with fuel. However, when CO concentrations about the source are above a maximum threshold, the system communicates with the fuel supply to cause the gas valve thereof to close and interrupt the supply of fuel to the potential source of CO. In this regard, the potential source of CO is rendered incapable of contributing to the unacceptable concentration of CO about the source because it's no longer burning fuel. Additionally, the system may include a light emitting diode that is lit when the detector causes the gas valve of the fuel supply to close.

In one embodiment, the system is operatively coupled to a potential source of CO, such as a furnace, and a thermostat. The system is operable to power (e.g., turn on or off) the thermostat via, for example, a power line from the system to the thermostat. The thermostat is operably coupled to the potential source of the CO and is operable to turn on or off the burning of fuel by the potential source of the CO. For example, the thermostat may be operably coupled to a potential source of the CO, such as a furnace, via a control line that turns on or off the furnace allowing the furnace to produce heat when turned on. The system includes a CO detector. During normal operation (e.g., no CO detection), the system receives power on a power line from the furnace and provides power to (e.g., turns on or causes to remain on) the thermostat. In this fashion, the thermostat is enabled to turn on or off the furnace, which, when turned on, burns fuel to produce heat, for example. If, however, the CO detector detects CO levels at or above a maximum threshold, the system removes power from (e.g., turns off) the thermostat, thus causing a loss of power on the control line from the thermostat to the furnace. As a result, not only is the furnace turned off, the thermostat is also disabled from turning on the furnace.

In one embodiment, when system detects that CO levels are below a minimum threshold, the system re-applies power to the thermostat, thereby allowing the thermostat to control the burning of fuel by the source of the CO. In another embodiment, the system will not reapply power to the thermostat until a mechanical lock is deactivated from the system.

One advantage of various embodiments described herein is that power to a potential source of a dangerous gas, such as CO, is automatically shut off such that the potential source of CO is disabled from continuing to potentially produce the dangerous gas. Another advantage of various embodiments described herein is that if the potential source of CO, such as a furnace, includes a fan that circulates air, the fan is also disabled from continuing to spread the CO as the fan may also be shut off. Another advantage of various embodiments is to provide systems and methods that result in a change to a fuel supply of a potential source of CO when CO concentrations detected about the source exceed a threshold concentration. Yet another advantage of various embodiments is that the systems and methods disclosed and described herein provide for communication between a CO detector and a fuel supply of a potential CO source that enables automatic changes to the fuel supply that do not require intervention by an individual. Yet another advantage of various embodiments is that the systems and methods disclosed and described herein provide for communication between a CO detector and a fuel supply of a potential CO source that enables expeditious changes to the fuel supply that do not require intervention by an individual.

Among other advantages, new potential sources of CO, such as a household appliance, may be originally improved at manufacture to provide the system disclosed and described herein at relatively low additional cost. Another advantage of embodiments of the present disclosures is that existing potential sources of CO, such as a household appliance, may be retrofit to provide the system disclosed and described herein at relatively low cost. Another advantage of embodiments of the present disclosures is that the systems and methods disclosed and described herein obviate the risk of audible alarm failure in CO detectors. For example, embodiments may include a system that is optionally integrated with a potential CO source, which may obviate the risk of audible alarm failure in a CO detector, and may quickly remediate or shut down a faulty source of CO without requiring intervention by an individual. As such, the time between when CO is first produced and when it is stopped at its source is minimized. Persons of ordinary skill in the art will recognize other advantages as well.

BRIEF DESCRIPTION OF THE DRAWINGS

The embodiments will be more readily understood in view of the following description when accompanied by the below figures and wherein like reference numerals represent like elements, wherein.

DETAILED DESCRIPTION OF THE PREFERRED EMBODIMENTS

Figure 1:
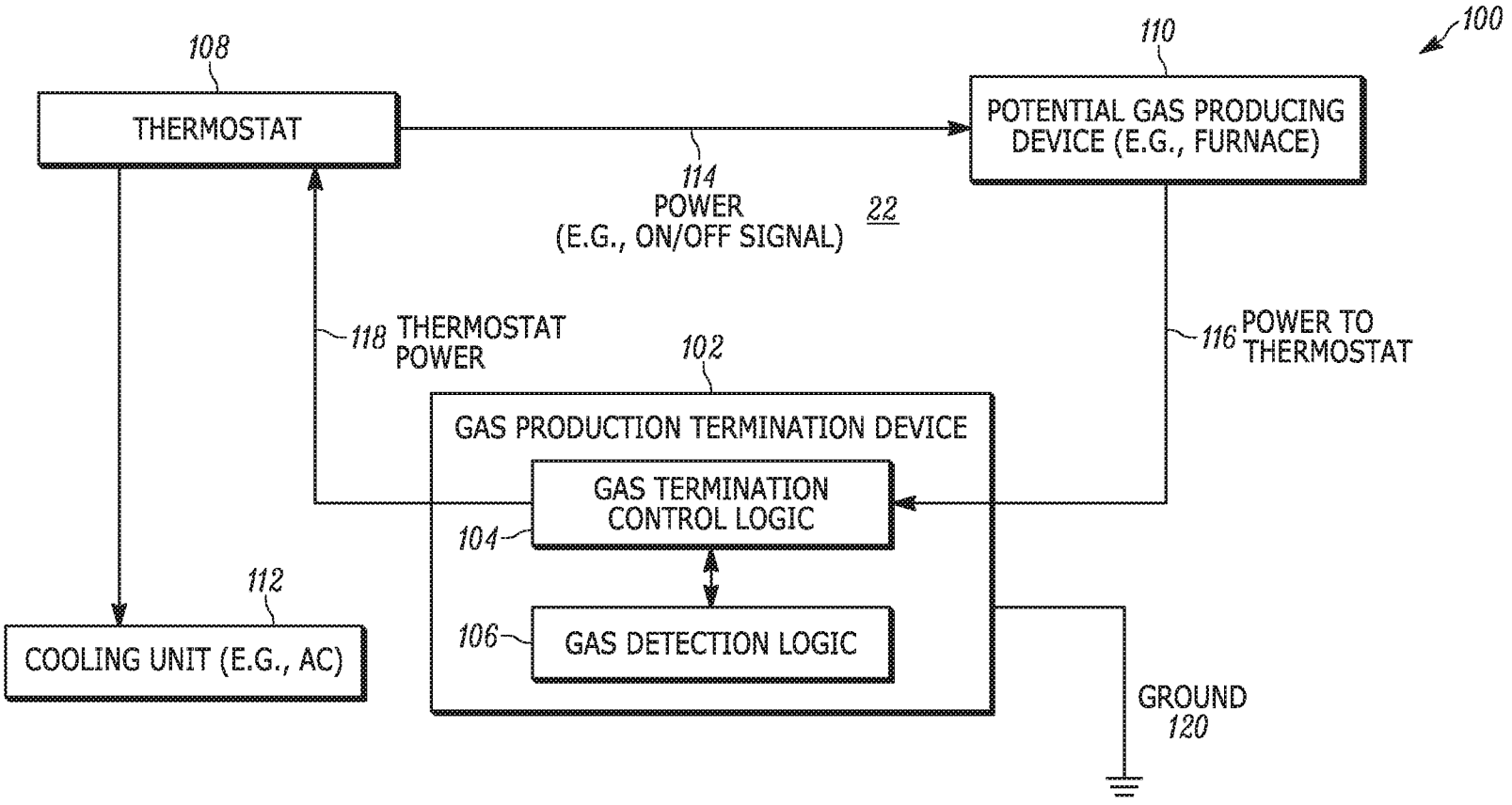
FIG. 1 is a block diagram illustrating an example system employing a gas production termination device in accordance with one example set forth in the disclosure.

While the disclosures may be susceptible to embodiments in different forms, there is shown in the drawings, and herein will be described in detail, specific embodiments with the understanding that the present disclosure is to be considered an exemplification of the principles of the disclosures, and is not intended to limit the disclosures to that as illustrated and described herein. Additionally, it will be understood that like or analogous elements and/or components, referred to herein, may be identified throughout the drawings by like reference characters. It will be likewise understood that the drawings are merely schematic representations of the disclosures, and some of the components may have been distorted from actual scale for purposes of pictorial clarity.

Briefly, apparatus and methods for detecting and terminating production of undesirable gases, such as carbon monoxide ("CO"), at a potential source, such as a household appliance. The apparatus and methods may determine a threshold level of the gas. In one embodiment, the method and apparatus may determine whether to provide power to a power supply input of a controller (e.g., a control board) of a potential gas producing device based on the detected level of gas, where providing power to the power supply input of the controller of the potential gas producing device enables the controller of the potential gas producing device to provide power to the potential gas producing device. In another embodiment, when gas concentrations about a potential source are above a maximum threshold, the system communicates with a fuel supply valve of the potential source to cause the valve thereof to interrupt the supply of fuel to the potential source.

In one embodiment, an apparatus for the cessation of gas production includes gas detector logic operable to detect a threshold level of gas and provide a gas detection output signal based on the detected threshold level of gas. The apparatus includes gas termination control logic, operably coupled to the gas detector logic, that includes a power receive input configured to receive power from a potential gas producing device. The gas termination control logic may also include a power supply output configured to supply power to a controller of the potential gas producing device. For example, an existing system may include a control board of a potential gas producing device, such as a furnace, which provides power from a transformer directly to the potential gas producing device to allow it to operate. Instead, the apparatus may be inserted into the system by cutting (e.g., bypassing) the direct power connection from the control board to the potential gas producing device and instead routing the power output of the control board to the power receive input of the gas termination control logic of the apparatus. The power supply output of the gas termination logic may then be routed to the control board.

The gas termination control logic may also include detection logic (e.g., a detection circuit) operable to receive the gas detection output signal from the gas detector logic and provide a gas termination output signal based on the received gas detection output signal. The gas termination logic may also include relay logic (e.g., a relay circuit) operable to receive power from the power receive input and determine whether to provide power received from the power receive input to the power supply output based on the gas termination output signal from the detection logic. For example, when power is provided on the power supply output to the controller of the potential gas producing device, the controller is operable (e.g., able) to provide power to the potential gas producing device. However, when power is not provided on the power supply output, the controller is disabled from providing power to the potential gas producing device.

In one embodiment, the detection logic is operable to provide a first voltage level on the gas termination output signal or a second voltage level on the gas termination output signal based on the received gas detection output signal. For example, the detection logic may provide a higher voltage (e.g., 5 volts) on the gas termination output signal when the received gas detection output signal is active (e.g., high if active high, or low if active low), and a comparatively lower voltage (e.g., 0 volts) when the received gas detection output signal is not active. As such, based on the received gas termination output signal from the detection logic, the relay logic may determine whether to provide power received from the power receive input to the power supply output.

In one embodiment, the relay logic is operable to select between a first output signal and a second output signal, wherein the relay logic is operable to provide power received from the power receive input to the first output signal or the second output signal based on the gas termination output signal from the detection logic. For example, the relay logic may provide power received from the power receive input to the first output signal when the detection logic provides the first voltage level on the gas termination output signal. Similarly, the relay logic may provide power received from the power receive input to the second output signal when the provides the second voltage level on the gas termination output signal.

In one example, the gas detector logic provides a first voltage level on the gas detection output signal when the gas detector logic detects a level of gas below the threshold level of gas. The gas detector logic may provide a second voltage level on the gas detection output signal when the gas detector logic detects a level of gas at or above the threshold level of gas. For example, the gas detector logic may deactivate the gas detection output signal when the gas detector logic detects a level of gas below the threshold level of gas, and may activate the gas detection output signal when the gas detector logic detects a level of gas at or above the threshold level of gas.

In one example, a controller of the potential gas producing device is a control board of the potential gas producing device, wherein the control board is operable to provide power to the potential gas producing device. In this example, the apparatus is operable to control power to the potential gas producing device via the control board (e.g., turn on or off power). In another example, the controller of the potential gas producing device is an electronic fuel valve of the potential gas producing device, where the electronic fuel valve is operable to provide fuel to the potential gas producing device, where the potential gas producing device consumes fuel when provided with fuel from the electronic fuel valve. In this example, the apparatus is operable to control whether fuel flows to the potential gas producing device. In yet another example, the controller of the potential gas producing device is a thermostat operatively coupled to the potential gas producing device, where the thermostat is operable to provide power to the potential gas producing device, where the potential gas producing device consumes fuel when provided with power from the thermostat. In this example, the apparatus is operative to enable or disable the potential gas producing device from operating via the thermostat.

Among other advantages, the apparatus and methods disable a potential gas producing device, such as a furnace, from consuming additional fuel that may lead to the production of gases, such as CO. For example, the apparatus and methods may disable a potential gas producing device when a threshold level of gas is detected, thus preventing it from burning additional fuel. As another example, the apparatus and methods may prevent power from being provided to a potential gas producing device when a threshold level of gas is detected, thus preventing it from burning additional fuel. As such, the apparatus and methods automatically prevent a potential gas producing device from producing further gas, potentially saving lives that may be at risk due to dangerous gas production.

Turning now to the drawings, FIG. 1 shows an example system 100 employing a gas production termination device 102. Gas production termination device 102 is operatively coupled to potential gas producing device 110, and to thermostat 108. Potential gas producing device 110 may be any engine or appliance that burn fossil fuels, such as a furnace, motor vehicle, stove, clothes dryer, water heater, or gas generator, among other examples. Thermostat 108 is operatively coupled to cooling unit 112 such that thermostat 108 is operable to turn on or off cooling unit 112. Thermostat 108 provides power signal 114 to potential gas producing device 110 which signals potential gas producing device 110 to turn on or off. For example, if power signal 114 is active, potential gas producing device 110 turns on and may burn fuel, such as a furnace turning on and burning fuel to produce heat. If, however, power signal 114 is inactive, potential gas producing device 110 turns off and does not burn fuel (e.g., furnace is off and is not producing heat). Potential gas producing device 110 provides power, such as 24 Volts, over power line 116 to gas production termination device 102.

In this example, gas production termination device 102 includes gas termination control logic 104 operatively coupled to gas detection logic 106. Gas production termination device 102 is connected to a ground (e.g., house ground, common ground) over connection 120. Gas detection logic 106 is operable to detect a threshold level of gas, such as CO, and provide a gas detection output signal to gas termination control logic 104 based on the detected threshold level of gas. Gas detection logic 106 may be, for example, a CO detector as is known in the art. For example, gas detection logic 106 may indicate to gas termination control logic 104 that it has detected a level of gas that is at or above a maximum threshold.

Gas termination control logic 104 may receive power from potential gas producing device 110 over power line 116, and is operable to supply power to a controller of the potential gas producing device, such as thermostat 108. In this example, gas termination control logic 104 may supply power to thermostat 108 over thermostat power line 118. Gas termination control logic 104 is operable to determine whether to provide power received from potential gas producing device 110 over power line 116 to thermostat 108 over thermostat power line 118 based on the indication of gas detection from gas detection logic 106. For example, if a gas detection output signal from gas detection logic 106 to gas termination control logic 104 indicates that little or no gas is detected (e.g., any gas detected is below a maximum threshold level), then gas termination control logic 104 provides power on thermostat power line 118.

Supplying power to thermostat 108 enables thermostat 108 to provide power to the potential gas producing device 110. For example, by supplying power to thermostat 108 over thermostat power line 118, thermostat 108 is enabled to turn on or off potential gas producing device 110 via power signal 114. If however, gas detection output signal from gas detection logic 106 to gas termination control logic 104 indicates that a maximum threshold of gas is detected, then gas termination control logic 104 does not provide power (e.g., cuts power) on thermostat power line 118. As such, thermostat 108 is disabled from turning on potential gas producing device 110 via power signal 114. In one example, gas termination control logic 104 includes relay logic such that the power received over power line 116 is provided as power on thermostat power line 118 when gas detection logic 106 indicates there is no gas detection at or above a maximum threshold.

Figure 2:
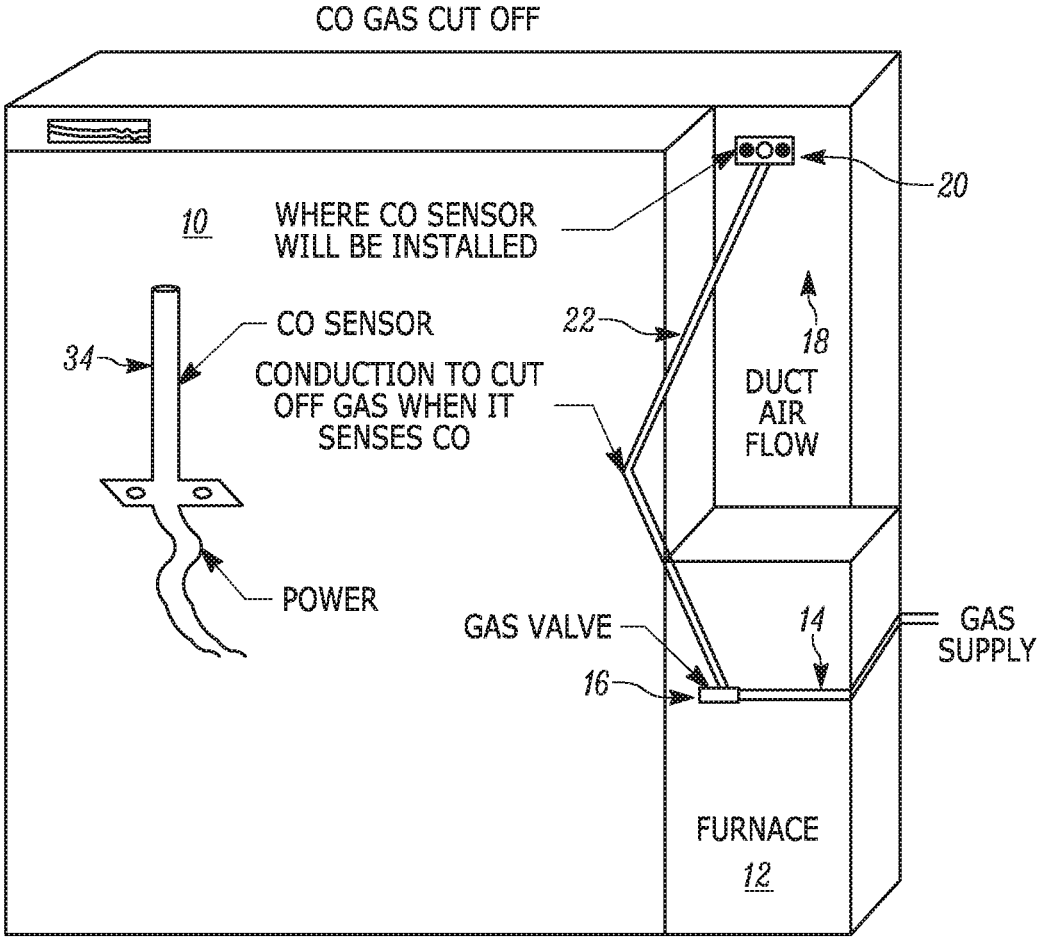
FIG. 2 is a block diagram illustrating another example of another embodiment of a gas production termination device that includes a carbon monoxide ("CO") detector that is both operatively associated with a potential source of CO and in communication with a fuel supply of the source in accordance with one example set forth in the disclosure.

FIG. 2 shows an example of a system 10 for cessation of CO production provided in accordance with an embodiment of the present disclosures. As shown in FIG. 2, the system 10 preferably comprises a potential source of CO 12 (which is an example of the potential gas producing device 110 of FIG. 1), a fuel supply 14, a valve 16, an airflow channel 18, a gas production termination device 20 (which may be, for example, gas production termination device 102 of FIG. 1), and a connection 22. Gas production termination device 20 may include a CO sensor 34 (shown separately). As shown in the figure, the potential source of CO 12 may include a household appliance that consumes a fossil fuel, such as a furnace, water heater, boiler, stove, or clothes dryer. Alternatively, the potential source of CO 12 may be another potential source of CO typically found in an enclosed space where individuals may be located, such as a fireplace or a motor vehicle (i.e., in a garage). As indicated in the figure, fuel is delivered to the potential source of CO 12 via the gas supply line 14, which may be a conduit having gas valve 16 which controls the flow of fuel to the potential source of CO 12. In some embodiments, gas valve 16 may be a solenoid valve.

The potential source of CO 12 is associated with an airflow channel 18, such as, for example, a plenum, ductwork, or a combination of both a plenum and ductwork. For example, the airflow channel 18 may be comprised of ductwork through which air is transferred from a furnace in a home. It is further contemplated that if the potential source of CO 12 is, for example, a fireplace or motor vehicle, the airflow channel 18 may be a chimney or an exhaust system, respectively.

The gas production termination device 20 is operatively associated with the potential source of CO source 12 and is in communication with gas valve 16 over connection 22. For example, the gas production termination device 20 is preferably installed at the airflow channel 18 of the potential source of CO 12, and the gas production termination device 20 may be in wired or wireless communication with gas valve 16. Alternatively, the detector 20 may be positioned on the potential source of CO 12, or any position where gas production termination device 20 may be exposed to airflow about or from the potential source of CO 12. In this example, gas production termination device 20 is operative to enable or disable the gas valve (e.g., allow or disallow fuel to flow via gas supply 14). For example, gas production termination device 20 may disable gas valve 16 if CO sensor 34 detects CO levels at or above a maximum threshold level.

In one example, when the sensor 34 detects unacceptable amounts of CO about a potential source of CO 12, the interruption of fuel to the potential source of CO 12 by gas production termination device 20 prevents the potential source of CO 12 from burning fuel to produce additional CO. The interruption is preferably automatic and instantaneous, thus obviating any intervention or potentially harmful exposure to accumulated CO by an individual intending to stem the CO production by manually disrupting the gas supply 14 or shutting down the potential source of CO 12.

Figure 3:
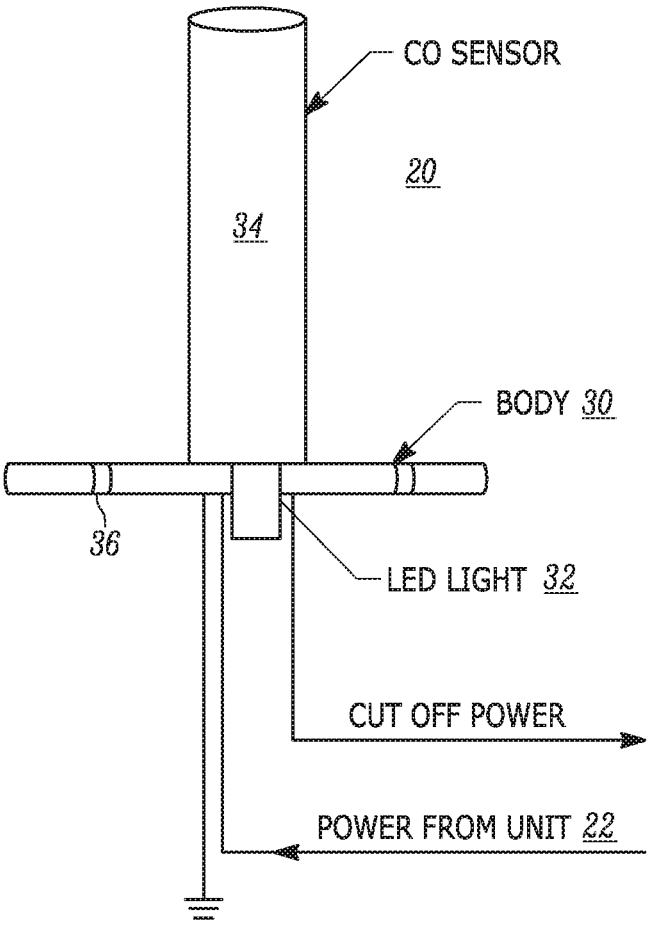
FIG. 3 is a top view of the gas production termination device with the CO detector of FIG. 2 in accordance with one example set forth in the disclosure.

FIG. 3 shows a top view of the gas production termination device 20 of FIG. 2 in one embodiment. The gas production termination detector 20 may be comprised of a body 30, a light emitting diode ("LED") 32, a CO sensor 34, and at least one mounting screw 36. Gas production termination device 20 may also receive power from the potential source of CO 12 over, for example, connection 22. In this embodiment, gas production termination device 20 may be in communication with a power supply of the potential source of CO 12 over, for example, connection 22, such that gas production termination device 20 is operable to cut power to potential source of CO 12, as described above with respect to FIG. 1.

Figure 4:
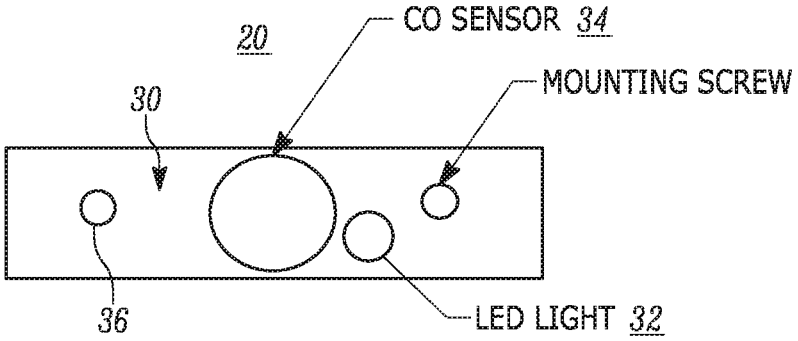
FIG. 4 is a side view of the gas production termination device with the CO detector of FIG. 2 in accordance with one example set forth in the disclosure.

FIG. 4 shows a side view of the gas production termination device 20 of FIG. 2 in one embodiment. For example, the figure includes a side view of the body 30, the LED 32, the CO sensor 34, and at least one mounting screw 36 of gas production termination device 20.

Figure 5:
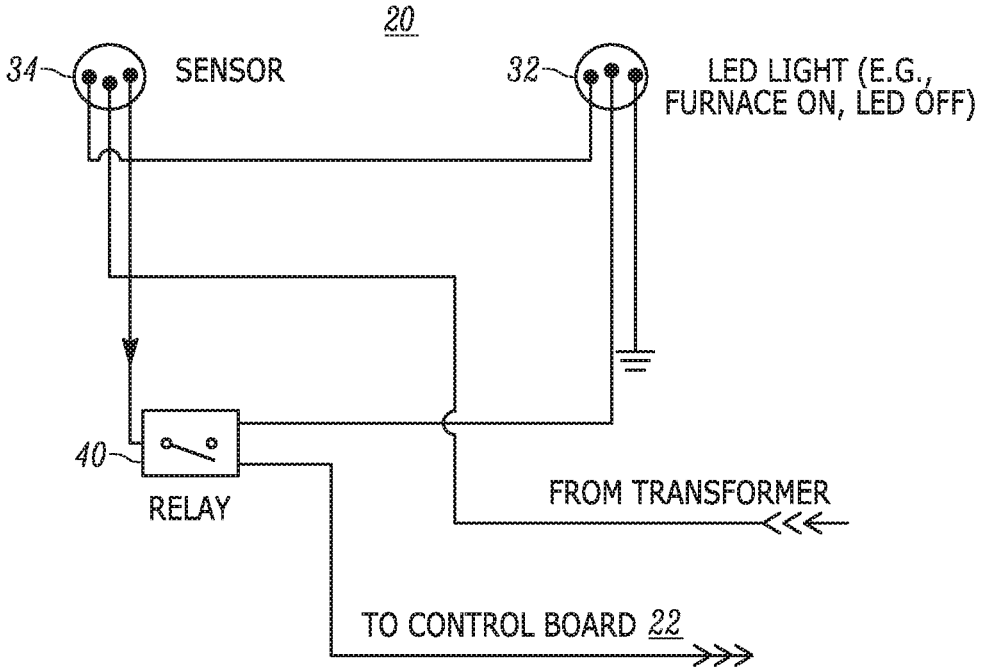
FIG. 5 is a wiring diagram of an example gas production termination device that includes a relay in one position when CO concentrations about a potential source of CO are below a maximum threshold in accordance with one example set forth in the disclosure.
Figure 6:
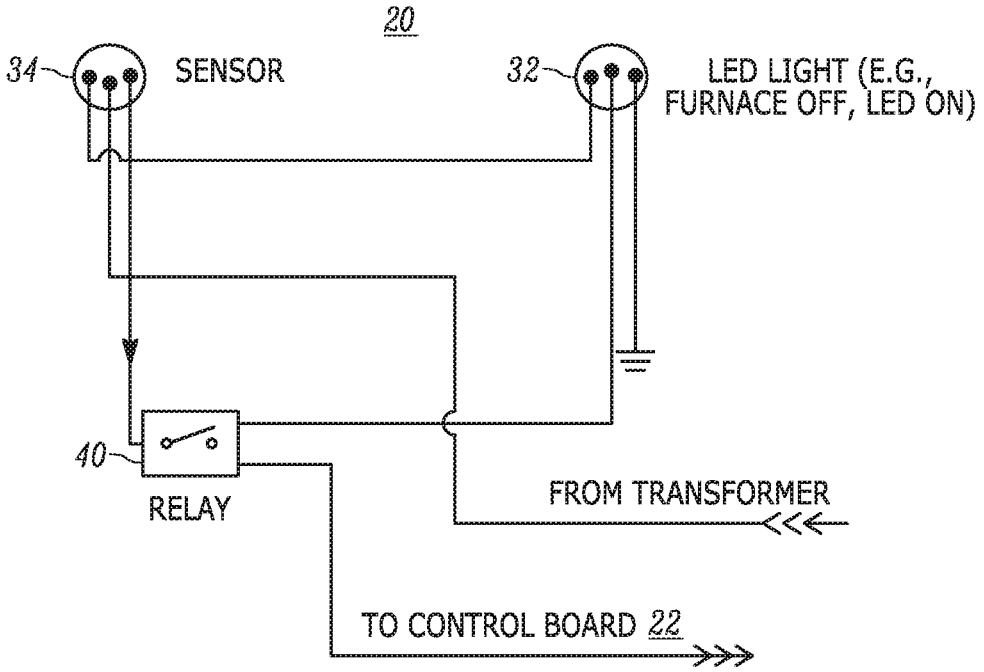
FIG. 6 is a wiring diagram of the example gas production termination device that includes a relay in another position when CO concentrations about a potential source of CO are at or above a maximum threshold in accordance with one example set forth in the disclosure.

FIGS. 5-6 are wiring diagrams of an example gas production termination device 20. FIG. 5 shows a wire diagram of the gas production termination device 20 during normal operation when CO is not detected by CO sensor 34. The gas production termination device 20 may be operatively coupled to a potential source of CO, such as a furnace. For example, the gas production termination device 20 may be operatively coupled to a control board of a furnace that regulates power from a transformer to the furnace (e.g., as described further below with respect to FIG. 8). The gas production termination device 20 may also be operatively coupled to a transformer, where the transformer operates to provide power to the furnace. As shown in FIG. 5, the gas production termination device 20 further includes a relay 40 and LED 32. When CO concentrations are below a maximum threshold about a potential source of CO, such as the potential source of CO 12 of FIG. 2, the relay 40 causes completion of an electrical circuit to exclude LED 32 from the circuit while concurrently supplying power received from the transformer to the control board of the potential source of CO. Such circumstances are typically found when a potential source of CO is operating normally and not producing unacceptable amounts of CO in a given space.

As shown in FIG. 6, however, when CO concentrations detected by CO sensor 34 of the gas production termination device 20 meet or exceed a maximum threshold, the relay 40 causes completion of an electrical circuit to remove power from the potential source of CO while concurrently supplying power to the LED 32. The electrification of the LED causes it to light, while the lack of power to the control board of the potential source of CO prevents the potential source of CO from generating further amounts of CO. In some embodiments, the gas production termination device 20 and the potential source of CO may be in wireless communication, such that the gas production termination device 20 may wirelessly cut off fuel or power to the potential source of CO.

Figure 7:
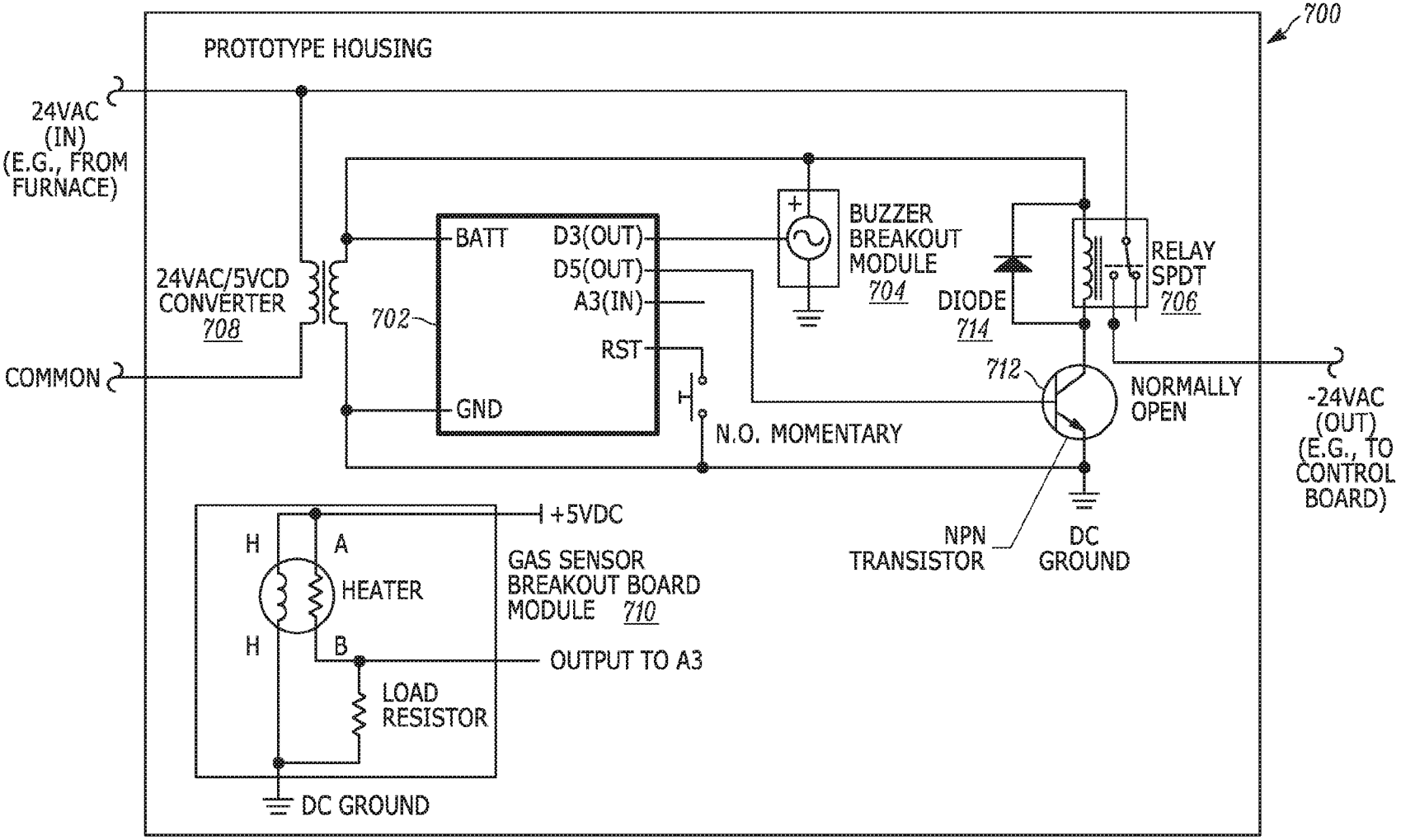
FIG. 7 is a circuit diagram as may be employed by the gas production termination device of FIG. 1 in accordance with one example set forth in the disclosure.

FIG. 7 is a circuit diagram for a circuit 700 that may be employed by, for example, the gas production termination device of FIG. 1. Circuit 700 includes gas sensor breakout board module 710 which may be operable to detect a threshold level of gas and provide a gas detection output signal (e.g., Output to A3) based on the detected threshold level of gas. Circuit diagram 700 also includes a power receive input (e.g., 24 VAC In) configured to receive power from a potential gas producing device, such as a furnace, and a power supply output (e.g., 24 VAC Out) configured to supply power to a controller of the potential gas producing device. Circuit 700 further includes detection logic 702 operable to receive a gas detection output signal from the gas sensor breakout board module 710 and provide a gas termination output signal (e.g., D5 Out) based on the received gas detection output signal. In this example, the gas termination output signal (i.e., D5 Out signal) is coupled to transistor 712. Circuit 700 also includes a relay 706. Diode 714 is coupled to relay 706 as indicated in the figure. Depending on the voltage applied to transistor 712 by detection logic 702, relay 706 selects one of two outputs. As such, relay 706 may provide power received from power receive input (e.g., 24 VAC In) to either one of the relay's 706 two outputs. Circuit diagram 700 also includes an AC-to-DC converter 708 which may convert AC voltages to DC voltages. The DC voltages may be used by circuit 700 for powering its various components.

In one example, relay 706 is in the "Open" position such that it is routing power received from the power receive input (e.g., 24 VAC In) to a controller of a potential gas producing device (e.g., such as a thermostat or control board). Subsequently, gas sensor breakout board module 710 activates the gas detection output signal that is routed to the A3 (IN) input of detection logic 702 when it detects an amount of gas that is at or above a threshold. In response, detection logic 702 activates its D5(Out) output which changes the voltage drop across transistor 712 thereby causing relay 706 to switch to its other position (e.g., "Closed" position). Circuit 700 may also include buzzer 704 which may be operatively coupled to detection logic 702 via, for example, the detection logic's 702 D3(Out) output. In one example, detection logic 702 activates its D3(Out) output whenever its A3 (IN) input is activated. As such, detection logic 702 may cause buzzer 704 to sound an alarm, such as when gas sensor breakout board module 710 detects an amount of gas that is at or above a threshold and activates detection logic's 702 A3 (IN) input.

In one embodiment, if detection logic 702 activates the gas termination output signal (in this example, D5(Out) output), the output remains activated until power is cycled to circuit 700. In another embodiment, circuit 700 includes a reset switch such that when the gas termination output signal is activated, detection logic 702 keeps it activated until a reset is performed via the reset switch. The reset switch may be, for example, a button that is to be depressed. In one example, the circuit 700 is in a locked casing such that the reset button is not accessible unless the casing is opened. The casing may be, for example, such that only emergency personnel have access (e.g., a key) to open the casing and thus access the reset button. In one embodiment, the reset switch may be accessed wirelessly.

Figure 8:
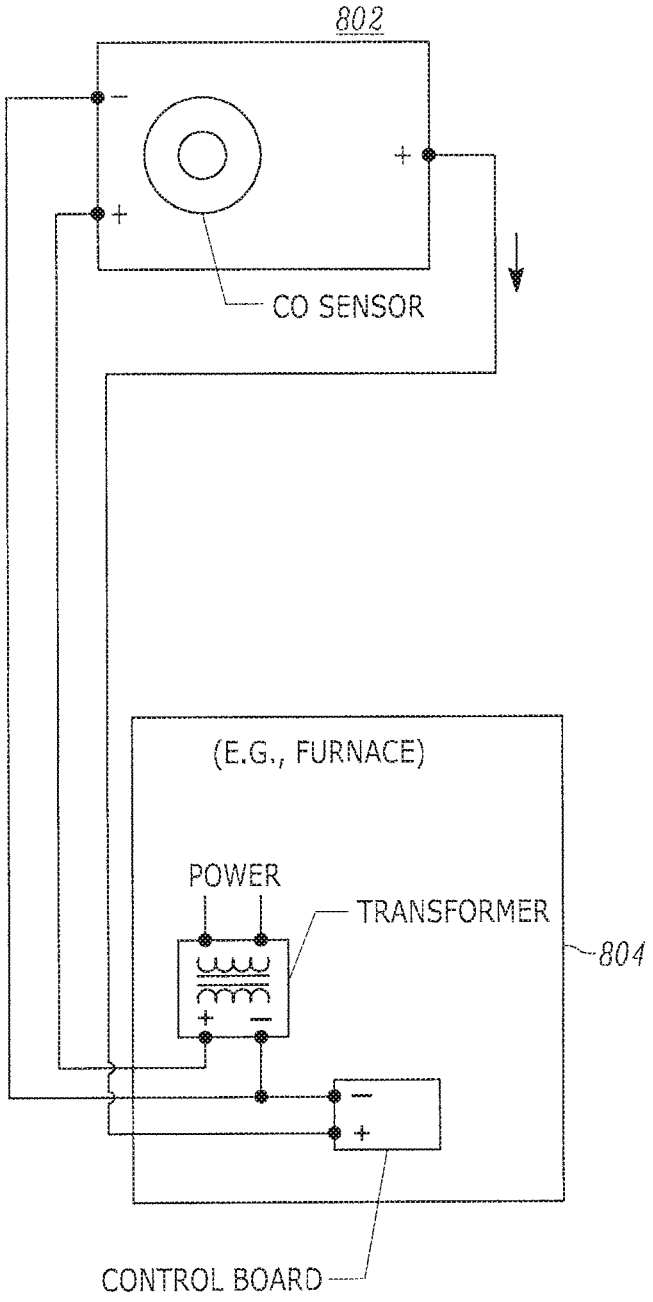
FIG. 8 is a wiring diagram employing an example gas production termination device coupled to a control board of a potential gas producing device in accordance with one example set forth in the disclosure.

FIG. 8 shows a wiring diagram employing an example gas production termination device 802, that includes a CO sensor, and that is coupled to a control board of a potential gas producing device 804. Gas production termination device 802 may be, for example, the gas production termination device 102 of FIG. 1. As shown in the figure, potential gas producing device 804 includes a transformer that converts comparatively higher voltage (e.g., 110 VAC) to comparatively lower voltage (e.g., 24 VAC). The control board of the potential gas producing device 804 provides the lower voltage so as to allow the potential gas producing device 804 to operate. In the prior art, the low side (e.g., 24 VAC side) of the transformer would be directly tied to control board, such that as long as the transformer is receiving voltage on the high-side (e.g., 110 VAC side), the control board would receive voltage and thus allow the potential gas producing device 804 to operate. In this embodiment, however, the low side of the transformer is operatively coupled to the gas production termination device 802. In addition, the control board is also operatively coupled to the gas production termination device 802. As such, gas production termination device 802 may enable or disable power to the control board. For example, in normal operation (e.g., CO sensor does not detect CO at or above a maximum threshold), gas production termination device 802 provides power from the low-side of the transformer to the control board. If, however, the CO sensor of gas production termination device 802 detects a level of CO at or above a maximum threshold, gas production termination device 802 is operable to cut off power to the control board. As such, the gas production termination device 802 is not provided with power, and thus does not operate.

It is contemplated that certain embodiments of the systems described herein may include a smartphone application executing on a smartphone, tablet, laptop, or other communication device that may be in communication with, for example, gas production termination device 102 or gas production termination device 20. Such an application may provide a user with information from a detector, such as gas detection logic 106 or CO sensor 34, including CO concentrations about a potential source of CO such as potential gas producing device 110. Additionally, a user may have the option to disrupt a fuel supply or cut power to (e.g., shut down) the potential gas producing device 110 using the smartphone application as desired.

As disclosed and described herein, some embodiments include methods for cessation of gas production. The example methods described herein may be carried out by the gas production termination device 102 of FIG. 1 or the gas production termination device 20 of FIG. 2. As such, the methods may be carried out by hardware or a combination of hardware and hardware executing software. Suitable hardware may include one or more GPUs, CPUs, APUs, ASICs, state machines, FPGAs, digital signal processors (DSPs), or other suitable hardware. In addition, it will be appreciated that many other ways of performing the acts associated with the methods described herein may be used. For example, the order of some operations may be changed, and some of the operations described may be optional. Additionally, while the methods may be described with reference to the example gas production termination devices 102, 20, it will be appreciated that the methods may be implemented by other apparatus as well, and that gas production termination devices 102, 20 may implement other methods.

Some embodiments include methods for cessation of gas production including: receiving a gas detection output signal based on a detected threshold level of gas; receiving power from a potential gas producing device on a power receive input; providing a gas termination output signal based on the received gas detection output signal; and determining whether to provide power received from the power receive input to a power supply output of a controller of the potential gas producing device based on the gas termination output signal from the detection logic, wherein providing power on the power supply output to supply power to the controller of the potential gas producing device enables the controller of the potential gas producing device to provide power to the potential gas producing device.

Some embodiments include methods for cessation of gas production comprising: providing a gas production termination device 20; operatively associating the gas production termination device 20 with a potential source of CO 12 having a gas supply 14; providing for communication between the gas production termination device 20 and the gas supply 14; detecting CO at predetermined threshold concentrations by the detector 20; and sending a signal from the gas production termination device 20 to the gas supply 14, wherein the signal causes a change to a valve 16 at the gas supply 14 effectively interrupting a supply of fuel to the potential source of CO 12.

In some examples, executable suitable instructions may be stored on a non-transitory computer readable storage medium, where the executable instructions are executable by one or more processors to cause the one or more processors to perform the actions described herein. Some or all of this functionality may also be implemented in any other suitable manner such as, but not limited to, a software implementation including, for example, a driver implementation, a firmware implementation, a hardware implementation, or any suitable combination of the example implementations described above.

The foregoing description has been presented for the purposes of illustration and description. It is not intended to be exhaustive or to limit the disclosures to the exemplary embodiments disclosed. Many modifications and variations are possible in light of the above teachings. It is intended that the scope of the disclosures be limited not by this detailed description of examples, but rather by the claims appended hereto. The above detailed description of the embodiments and the examples described therein have been presented for the purposes of illustration and description only and not by limitation. It is therefore contemplated that the present disclosures cover any and all modifications, variations, or equivalents that fall within the scope of the basic underlying principles disclosed above and claimed herein. While embodiments of the present disclosures may be shown and described, it is envisioned that those skilled in the art may devise various modifications of the present disclosures without departing from the spirit and scope of the disclosures.

The invention claimed is:

1. An apparatus for the cessation of gas production comprising:

gas detector logic operable to detect a threshold level of gas and provide a gas detection output signal based on the detected threshold level of gas; and gas termination control logic operably coupled to the gas detector logic and comprising:

a power receive input configured to receive power from a potential gas producing device having a controller and a transformer, the transformer being directly tied to the controller;

a power supply output configured to supply power to the controller of the potential gas producing device;

detection logic operable to receive the gas detection output signal from the gas detector logic and provide a gas termination output signal based on the received gas detection output signal; and relay logic operable to receive power from the power receive input and determine whether to provide power received from the power receive input to the power supply output based on the gas termination output signal from the detection logic, wherein the gas detector logic receives power from the transformer of the potential gas producing device and provides power to the controller of the potential gas producing device, wherein the detection logic is operable to provide a first voltage level on the gas termination output signal or a second voltage level on the gas termination output signal based on the received gas detection output signal, and wherein the relay logic provides power received from the power receive input to a first output signal when the detection logic provides the first voltage level on the gas termination output signal, the relay logic provides power received from the power receive input to a second output signal when the detection logic provides the second voltage level on the gas termination output signal.

2. The apparatus of claim 1, wherein the relay logic is operable to select between the first output signal and the second output signal, wherein the relay logic is operable to provide power received from the power receive input to the first output signal or the second output signal based on the gas termination output signal from the detection logic.

3. The apparatus of claim 1, wherein the gas detector logic provides a first voltage level on the gas detection output signal when the gas detector logic detects a level of gas below the threshold level of gas, and provides a second voltage level on the gas detection output signal when the gas detector logic detects a level of gas at or above the threshold level of gas.

4. The apparatus of claim 1 wherein the controller of the potential gas producing device is a control board of the potential gas producing device, wherein the control board is operable to provide power to the potential gas producing device.

5. The apparatus of claim 1 wherein the controller of the potential gas producing device is an electronic fuel valve of the potential gas producing device, wherein the electronic fuel valve is operable to provide fuel to the potential gas producing device, wherein the potential gas producing device consumes fuel when provided with fuel from the electronic fuel valve.

6. The apparatus of claim 1 wherein the controller of the potential gas producing device is a thermostat operatively coupled to the potential gas producing device, wherein the thermostat is operable to provide power to the potential gas producing device, wherein the potential gas producing device consumes fuel when provided with power from the thermostat.

7. A system for the cessation of gas production comprising:

a potential gas producing device including:

a transformer operative to transform high voltage to low voltage; and a controller operatively coupled to the transformer, wherein the controller is operative to receive the low voltage from the transformer and provide the low voltage to power the potential gas producing device, the transformer being directly tied to the controller; and a gas production termination device comprising:

gas detector logic operable to detect a threshold level of gas and provide a gas detection output signal based on the detected threshold level of gas; and gas termination control logic operably coupled to the gas detector logic and comprising:

a power receive input configured to receive power from the potential gas producing device;

a power supply output configured to supply power to the controller of the potential gas producing device;

detection logic connected directly to the gas detector logic and operable to receive the gas detection output signal from the gas detector logic and provide a gas termination output signal based on the received gas detection output signal; and relay logic operable to receive power from the power receive input and determine whether to provide power received from the power receive input to the power supply output based on the gas termination output signal from the detection logic, wherein providing power on the power supply output to supply power to the controller of the potential gas producing device enables the controller of the potential gas producing device to provide power to the potential gas producing device, wherein the detection logic is operable to provide a first voltage level on the gas termination output signal or a second voltage level on the gas termination output signal based on the received gas detection output signal, and wherein the relay logic provides power received from the power receive input to a first output signal when the detection logic provides the first voltage level on the gas termination output signal, the relay logic provides power received from the power receive input to a second output signal when the detection logic provides the second voltage level on the gas termination output signal.

8. The system of claim 7, wherein the relay logic is operable to select between the first output signal and the second output signal, wherein the relay logic is operable to provide power received from the power receive input to the first output signal or the second output signal based on the gas termination output signal from the detection logic.

9. The system of claim 7, wherein the gas detector logic provides a first voltage level on the gas detection output signal when the gas detector logic detects a level of gas below the threshold level of gas, and provides a second voltage level on the gas detection output signal when the gas detector logic detects a level of gas at or above the threshold level of gas.

10. The system of claim 7 wherein the controller of the potential gas producing device is a control board of the potential gas producing device, wherein the control board is operable to provide power to the potential gas producing device.

11. The system of claim 7 wherein the controller of the potential gas producing device is an electronic fuel valve of the potential gas producing device, wherein the electronic fuel valve is operable to provide fuel to the potential gas producing device, wherein the potential gas producing device consumes fuel when provided with fuel from the electronic fuel valve.

12. The system of claim 7 wherein the controller of the potential gas producing device is a thermostat operatively coupled to the potential gas producing device, wherein the thermostat is operable to provide power to the potential gas producing device, wherein the potential gas producing device consumes fuel when provided with power from the thermostat.

13. A method for the cessation of gas production comprising:

receiving a gas detection output signal based on a threshold level of gas detected by gas detector logic operable to detect the threshold level of gas;

receiving power from a transformer included in a potential gas producing device on a power receive input, the potential gas producing device having a controller and the transformer, the transformer being directly tied to the controller;

providing a gas termination output signal based on the received gas detection output signal by using detection logic operable to receive the gas detection output signal from the gas detector logic;

determining whether to provide power received from the power receive input to a power supply output of the controller of the potential gas producing device based on the gas termination output signal from the detection logic by using relay logic connected directly to the detection logic and operable to receive power from the power receive input, wherein providing power on the power supply output to supply power to the controller of the potential gas producing device enables the controller of the potential gas producing device to provide power to the potential gas producing device;

providing a first voltage level on the gas termination output signal or a second voltage level on the gas termination output signal based on the received gas detection output signal;

providing power received from the power receive input to a first output signal when the first voltage level is provided on the gas termination output signal; and providing power received from the power receive input to a second output signal when the second voltage level is provided on the gas termination output signal.

14. The method of claim 13 wherein determining whether to provide power received from the power receive input to the power supply output of the controller of the potential gas producing device based on the gas termination output signal from the detection logic comprises providing power received from the power receive input to the first output signal or the second output signal based on the gas termination output signal from the detection logic.

* * * * *